US007821466B2

(12) United States Patent
Lempkowski

(10) Patent No.: US 7,821,466 B2
(45) Date of Patent: Oct. 26, 2010

(54) NORMALLY OPEN AND NORMALLY CLOSED RF MEMS SWITCHES IN A MOBILE COMPUTING DEVICE AND CORRESPONDING METHOD

(75) Inventor: Robert Lempkowski, Elk Grove Village, IL (US)

(73) Assignee: Motorola-Mobility, Inc., Libertyville, IL (US)

( * ) Notice: Subject to any disclaimer, the term of this patent is extended or adjusted under 35 U.S.C. 154(b) by 131 days.

(21) Appl. No.: 11/694,009

(22) Filed: Jul. 17, 2008

(65) Prior Publication Data

US 2010/0013725 A1 Jan. 21, 2010

(51) Int. Cl.
*H01Q 9/00* (2006.01)

(52) U.S. Cl. ..... 343/745

(58) Field of Classification Search ..... 343/745; 335/205; 361/760, 781
See application file for complete search history.

(56) References Cited

U.S. PATENT DOCUMENTS

| | | | | |
|---|---|---|---|---|
| 6,426,687 | B1 * | 7/2002 | Osborn | 333/262 |
| 7,324,350 | B2 * | 1/2008 | Heck et al. | 361/760 |
| 2006/0181374 | A1 | 8/2006 | Lee et al. | |

* cited by examiner

*Primary Examiner*—Huedung Mancuso

(57) ABSTRACT

A mobile computing device and corresponding method are disclosed. The mobile computing device includes an RF MEMS switch circuit including at least one normally open RF MEMS switch and a normally closed RF MEMS switch and a controller connected to the RF MEMS switch circuit. The RF MEMS switch circuit applies a default condition to the mobile computing device through the normally closed RF MEMS switch, and the controller causes application of control signals to one of the at least one normally open RF MEMS switches and to the normally closed RF MEMS switch to apply an alternate condition to the mobile computing device instead of the default condition.

12 Claims, 6 Drawing Sheets

NORMALLY OPEN AND NORMALLY CLOSED RF MEMS SWITCHES IN A MOBILE COMPUTING DEVICE AND CORRESPONDING METHOD

BACKGROUND OF THE INVENTION

1. Field of the Invention

The invention relates to mobile computing devices, and in particular, to normally open and normally closed RF MEMS (micro-electro-mechanical systems) switches used in mobile computing devices.

2. Introduction

Mobile computing devices, such as cellular phones, handheld computers, MP3 players, laptop computers, etc. are very pervasive computing devices. The mobile computing devices provide various features, such as communications, computing features, Internet access, playing music or video, etc.

It may be desirable to provide the mobile computing devices with multiband abilities, or to have tunable antenna structures included. A commonly employed technology to provide such multiband capabilities or tunable antennas is to use RF MEMS (micro-electro-mechanical systems) switches. Such switches are typically constructed of a same switch mechanism (typically electrostatic) and use RF transmission line techniques to divide the RF signal to each switch throw. Using this method, any high voltage converter circuit would have to be continuously operating to provide control voltages to close one of the switch throws to pass the RF signal, or to open others, depending on the switch throw design. For example, where the design uses all normally open switches, the converter circuit would need to continuously operate to keep one of the switch throws closed.

Such a converter circuit may typically be a DC-DC converter that is continuously operating. Such continuous operation creates a continuous power drain, which can be a drain on battery life in portable computing devices, for example. It would be advantageous to provide an RF MEMS switch design for use with mobile computing devices that would allow the drive circuit to be in an idle or off condition to save on battery life, while still providing the desired functionality.

SUMMARY OF THE INVENTION

A mobile computing device and corresponding method are disclosed. The mobile computing device includes an RF MEMS switch circuit including at least one normally open RF MEMS switch and a normally closed RF MEMS switch and a controller connected to the RF MEMS switch circuit. The RF MEMS switch circuit applies a default condition to the mobile computing device through the normally closed RF MEMS switch, and the controller causes application of control signals to one of the at least one normally open RF MEMS switches and to the normally closed RF MEMS switch to apply an alternate condition to the mobile computing device instead of the default condition.

BRIEF DESCRIPTION OF THE DRAWINGS

In order to describe the manner in which advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

Various embodiments of the invention are discussed in detail below. While specific implementations are discussed, it should be understood that this is done for illustration purposes only. A person skilled in the relevant art will recognize that other components and configurations may be used without departing from the spirit and scope of the invention.

The invention comprises a variety of embodiments, such as a method and apparatus and other embodiments that relate to the basic concepts of the invention.

In a typical mobile computing device, various typical configurations include the use of RF MEMS switches. For example, cellular phones, handheld computers and other mobile computing devices often come equipped with multiband capabilities or tunable antennas, which may include RF MEMS switches. However, previous devices have used all normally open MEMS switches or all normally closed MEMS switches, requiring the use of continuously operating control voltages, as described above.

However, the invention provides an RF MEMS switch circuit that includes a normally closed MEMS switch and a normally open MEMS switch. One of the switch types is used to provide a default condition, while the other switch type is used to provide an alternate condition. For example, the normally closed MEMS switch may provide the default condition, while the normally open MEMS switch may provide the alternate condition. This is particularly advantageous when a default condition is primarily used, and the alternate condition is used less frequently, because the default condition may be provided without the use of a control voltage, as further described below. Additionally, any number of alternate conditions may be provided by employing additional MEMS switches, such as by having a plurality of normally open MEMS switches, each of which can provide an alternate condition.

Figure 1:
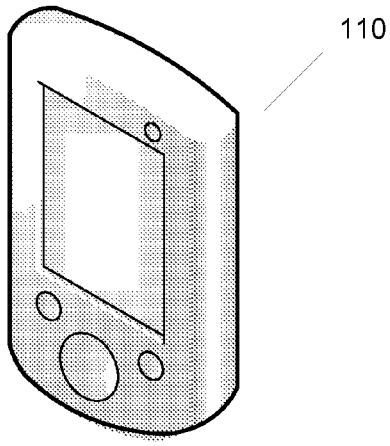
FIG. 1 illustrates an exemplary diagram of a mobile computing device in accordance with a possible embodiment of the invention.

FIG. 1 illustrates an exemplary diagram of a mobile computing device 110 in accordance with a possible embodiment of the invention. The mobile computing device 110 may be any mobile or portable computing device, including a mobile telephone, cellular telephone, a wireless radio, a portable computer, a laptop, an MP3 player, satellite radio, satellite television, Digital Video Recorder (DVR), television set-top box, etc.

Figure 2:
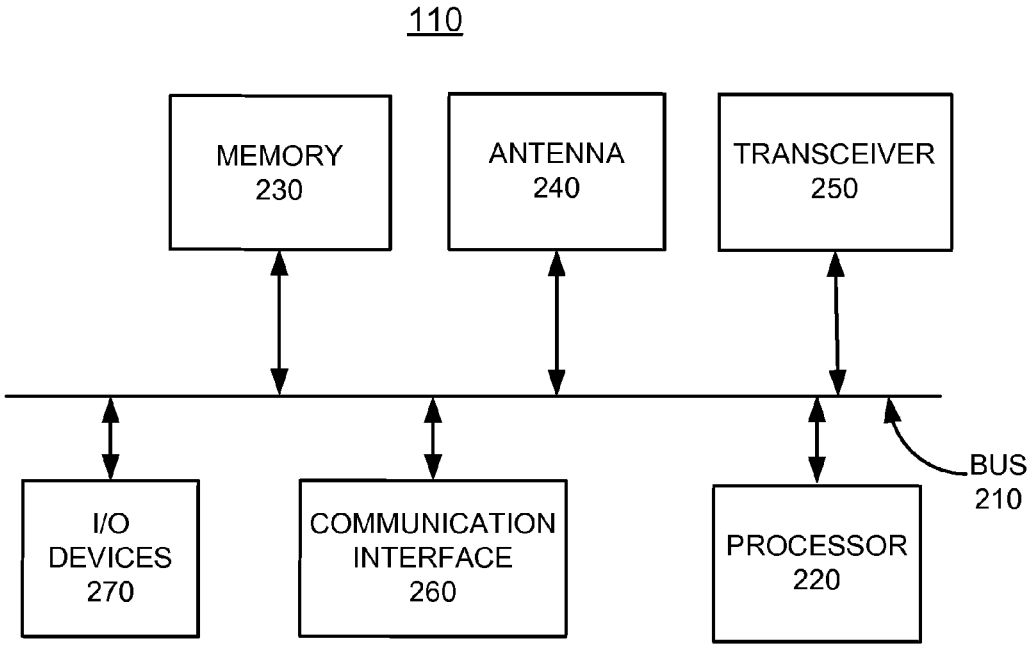
FIG. 2 illustrates a block diagram of an exemplary mobile computing device in accordance with a possible embodiment of the invention.

FIG. 2 illustrates a block diagram of an exemplary mobile computing device 110 in accordance with a possible embodiment of the invention. The exemplary mobile computing device 110 may include a bus 210, a processor 220, and a memory 230. The bus 210 may permit communication among the components of the mobile communication device 110. The mobile computing device 110 may include other optional elements such as an antenna 240, a transceiver 250, a communication interface 260, and input/output I/O) devices 270, although these elements may not be necessary to practice the invention.

Processor 220 may include at least one conventional processor or microprocessor that interprets and executes instructions. Memory 230 may be a random access memory (RAM or another type of dynamic storage device that stores information and instructions for execution by processor 220. Memory 230 may also include a read-only memory (ROM which may include a conventional ROM device or another type of static storage device that stores static information and instructions for processor 220.

Transceiver 240 may include one or more transmitters and receivers. The transceiver 240 may include sufficient functionality to interface with any network or communication station and may be defined by hardware or software in any manner known to one of skill in the art. The processor 220 is cooperatively operable with the transceiver 240 to support operations within the network.

Input/output devices I/O devices) may include one or more conventional input mechanisms that permit a user to input information to the mobile communication device 110, such as a microphone, touchpad, keypad, keyboard, mouse, pen, stylus, voice recognition device, buttons, etc. Output devices 270 may include one or more conventional mechanisms that output information to the user, including a display, printer, one or more speakers, a storage medium, such as a memory, magnetic or optical disk, and disk drive, etc., and/or interfaces for the above. The display may typically be an LCD display as used on many conventional mobile computing devices.

The mobile computing device 110 may perform functions in response to processor 220 by executing sequences of instructions or instruction sets contained in a computer-readable medium, such as, for example, memory 230. Such instructions may be read into memory 230 from another computer-readable medium, such as a storage device or from a separate device via a communication interface.

The mobile computing device 110 illustrated in FIGS. 1-2 and the related discussion are intended to provide a brief, general description of a suitable communication and processing environment in which the invention may be implemented. Although not required, the invention will be described, at least in part, in the general context of computer-executable instructions, such as program modules, being executed by the mobile computing device 110, such as a communications server, or a general purpose computer. Generally, program modules include routine programs, objects, components, data structures, etc. that perform particular tasks or implement particular abstract data types. Moreover, those skilled in the art will appreciate that other embodiments of the invention may be practiced in communication network environments with many types of communication equipment and computer system configurations, including cellular devices, mobile communication devices, personal computers, hand-held devices, multi-processor systems, microprocessor-based or programmable consumer electronics, cable or network switching equipment, and the like.

Figure 3:
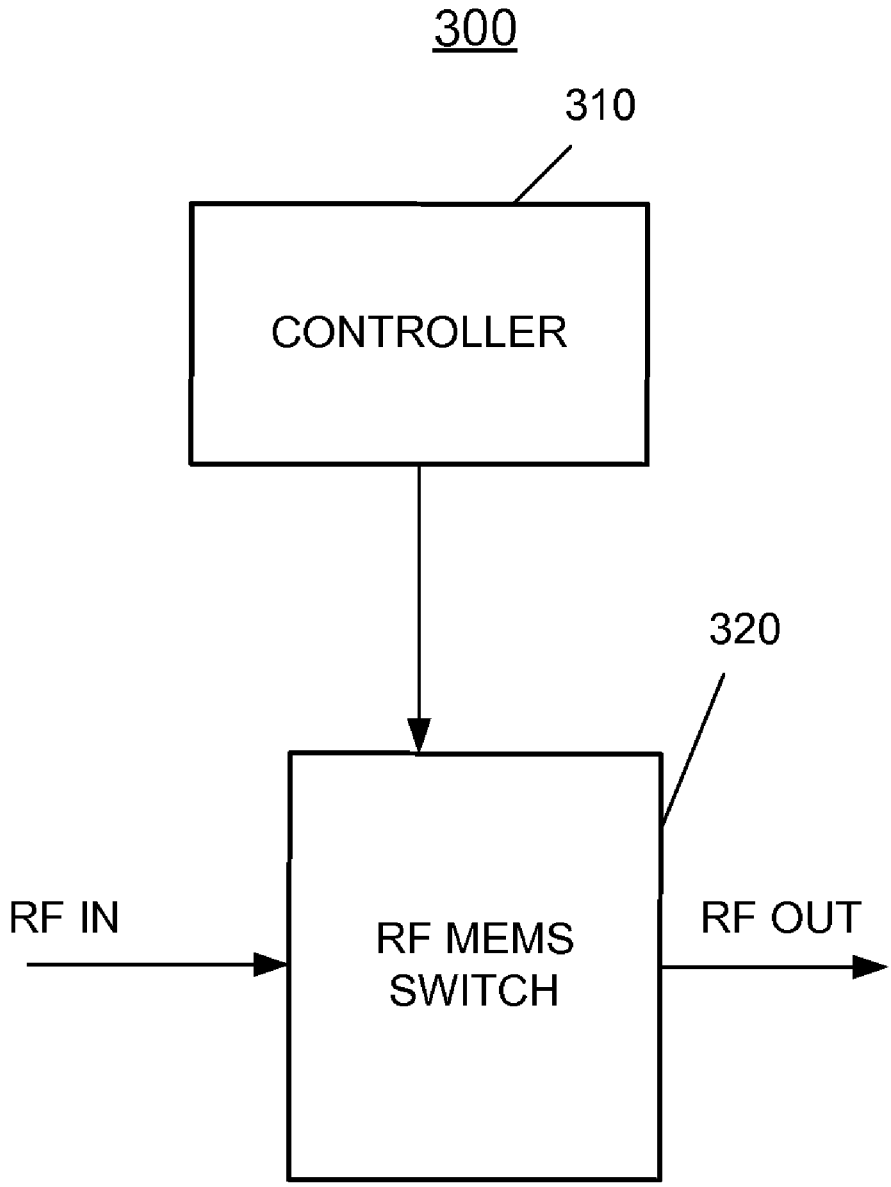
FIG. 3 illustrates an exemplary block diagram of an exemplary mobile computing device in accordance with a possible embodiment of the invention.

FIG. 3 illustrates an exemplary block diagram of system 300 of a mobile computing device in accordance with a possible embodiment of the invention. The system 300 may include a controller 310 and an RF MEMS switch 320. The controller 310 may be equivalent to the processer 220 and may interface with the memory 230 and other elements of FIG. 2. For example, the controller 310 may execute instructions saved in memory 230 to cause the MEMS switch 320 to operate in a desired manner. The controller 310 may cause control voltages to be applied to the RF MEMS switch 320, as explained below. The controller may interface with a circuit (not shown) that creates control voltages which may be applied to the RF MEMS switch 320.

In a default condition, the RF MEMS switch 320 supplies a default condition RF signal at the output RF OUT. No control voltage signals are needed by the RF MEMS switch 320 in the default condition, as further explained below.

Figure 4:
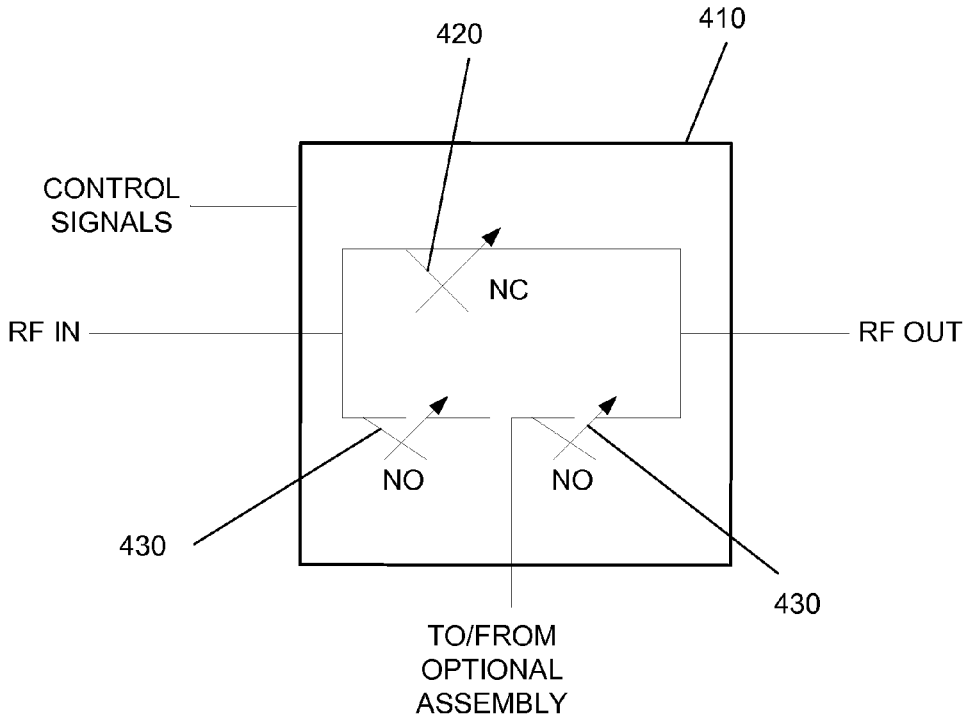
FIG. 4 illustrates an exemplary block diagram of an exemplary mobile computing device in accordance with a possible embodiment of the invention.

FIG. 4 illustrates a possible embodiment of a RF MEMS switch circuit 410 that may be used in accordance with embodiments of the invention. The RF MEMS switch circuit 410 includes a normally closed (NC) RF MEMS switch 420 and at least one normally open (NO) RF MEMS switch 430. The RF MEMS switch 410 receives control signals from the controller 310 which are used to control the normally closed RF MEMS switch 420 and the normally open RF MEMS switch 430. In a default condition (in this case, normal operation of the mobile computing device), no control signals are needed and the normally closed RF MEMS switch directs the RF IN signal to RF OUT.

In an alternate condition, the controller 310 directs control voltage signals to both the normally closed RF MEMS switch 420 and the normally open RF MEMS switch 430, causing the normally closed RF MEMS switch to be grounded, and causing the normally open RF MEMS switch to close. This results in the signal at RF IN to be directed through to the optional assembly and not directly to RF OUT. This embodiment is particularly useful for mobile computing devices that may need to be connected to a calibration or test device. Like other embodiments, this embodiment may be employed with any additional number of switches to provide additional alternate signal paths as desired. Additionally, there may be included in the path between the normally closed RF MEMS switch 420 and the output an additional optional assembly (such as amplifiers, filters, etc.) and an additional normally closed RF MEMS switch.

Figure 5:
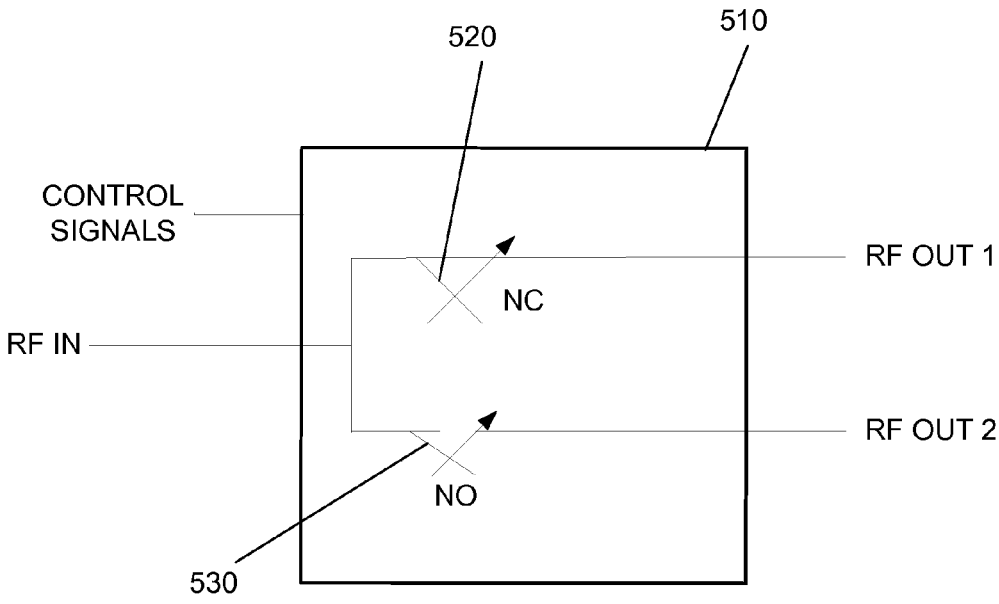
FIG. 5 illustrates an exemplary block diagram of an exemplary mobile computing device in accordance with a possible embodiment of the invention.

FIG. 5 illustrates a possible embodiment of a RF MEMS switch circuit 510 that may be used in accordance with embodiments of the invention. The RF MEMS switch circuit 510 includes a normally closed RF MEMS switch 520 and a normally open RF MEMS switch 530. The RF MEMS switch 510 receives control signals from the controller 310 which are used to control the normally closed RF MEMS switch 520 and the normally open RF MEMS switch 530. In a default condition (in this case, normal operation of the mobile computing device), no control signals are needed and the normally closed RF MEMS switch 520 directs the RF IN signal to RF OUT 1.

In an alternate condition, the controller 310 directs control voltage signals to both the normally closed RF MEMS switch 520 and the normally open RF MEMS switch 530, causing the normally closed RF MEMS switch to be grounded, and causing the normally open RF MEMS switch 530 to close. This results in the alternate RF OUT 2 signal at the output. Like other embodiments, this embodiment may be employed with any additional number of switches to provide additional RF OUT signals as desired to provide multiband switching.

Figure 6:
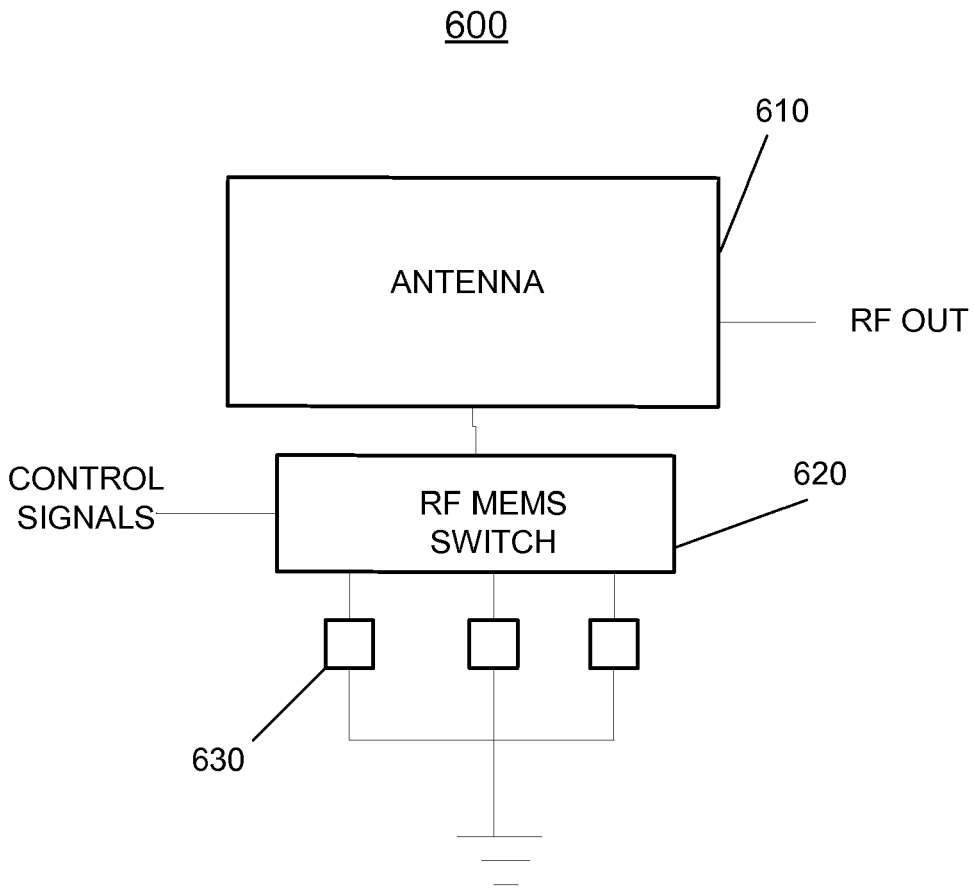
FIG. 6 illustrates an exemplary block diagram of an exemplary mobile computing device in accordance with a possible embodiment of the invention.

FIG. 6 illustrates a possible embodiment of a system 600 that may be used in accordance with embodiments of the invention. The system 600 includes an antenna 510, which is connected to an RF MEMS switch 620. The controller 310 directs control voltage signals to the RF MEMS switch 620. The RF MEMS switch 620 a SPMT (single pole multi throw) RF MEMS switch having, for example, one normally closed RF MEMS switch and two normally open RF MEMS switches, each of the switches being connected to the antenna and to one of the reactive components 630. The reactive components 630 may be capacitors or inductors of different values, for example.

The embodiment illustrated in FIG. 6 may be particularly advantageous for antenna tuning, where the antenna 610 may be tuned to different frequencies. The mobile computing device may employ a default frequency. The FIG. 6 embodiment may use a normally closed RF MEMS switch to connect the antenna 610 to one of the reactive components 630 which will tune the antenna to a default frequency. The remaining reactive components 630 are used to tune the antenna to alternate frequencies by applying appropriate control voltage signals to close the corresponding normally open RF MEMS switch to connect the corresponding reactive component 630 to antenna 610. This embodiment may be used to employ any number of desired frequencies by employing the corresponding number of switches. As an alternative to the reactive components, the RF MEMS switches may physically connect different physical positions along the antenna structure 610 to a common grounding location, thereby providing tuning of the antenna structure in a complementary fashion.

Figure 7:
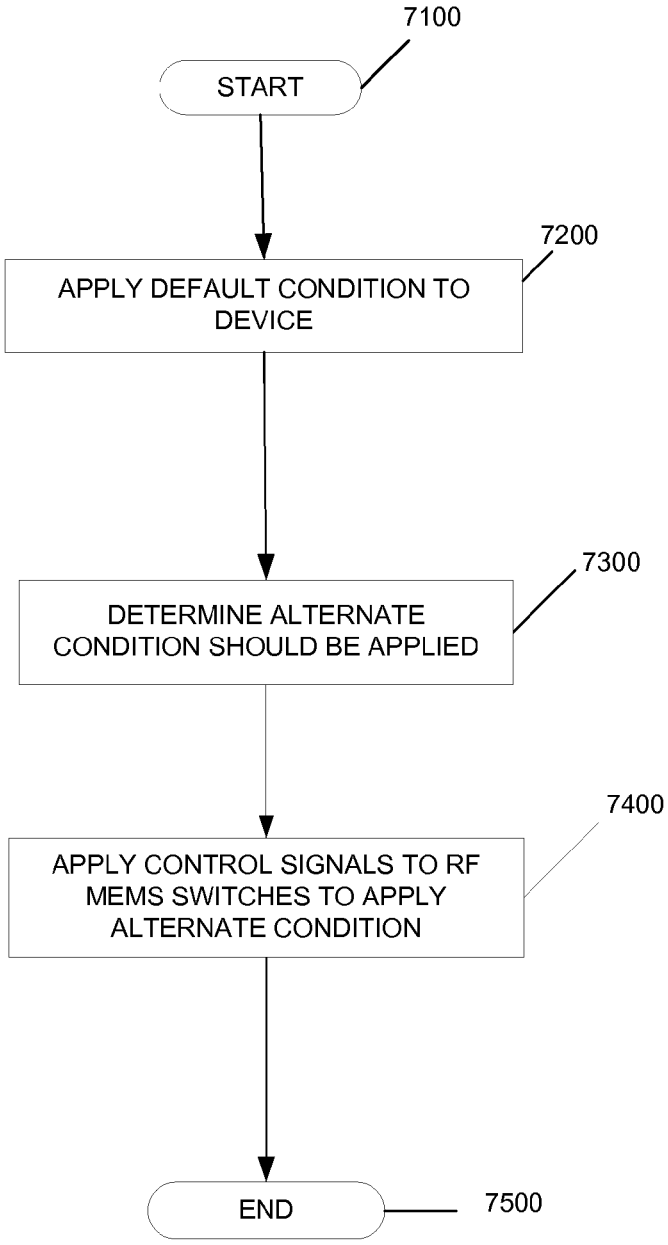
FIG. 7 is an exemplary flowchart illustrating one possible process in a mobile computing device in accordance with one possible embodiment of the invention.

FIG. 7 is an exemplary flowchart illustrating one possible process in accordance with a possible embodiment of the invention. The process starts at 7100. At 7200, a default condition is applied to the mobile computing device. The default condition may be applied through the normally closed RF MEMS switch, as described above.

In step 7300, the controller determines that an alternate condition should be applied. For example, the controller may determine that an alternate frequency needs to be employed.

In step 7400, the appropriate control signals are generated by or under the direction of the controller. The control signals are directed to the RF MEMS switches to cause application of the default condition. The process goes to step 7500, and ends.

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Although the above description may contain specific details, they should not be construed as limiting the claims in any way. Other configurations of the described embodiments of the invention are part of the scope of this invention. Accordingly, the appended claims and their legal equivalents should only define the invention, rather than any specific examples given.

I claim:

1. A mobile computing device comprising:

an RF MEMS switch circuit including a plurality of normally open RF MEMS switches and a normally closed RF MEMS switch;

a controller connected to the RF MEMS switch circuit;

an antenna connected to the RF MEMS switch circuit;

a first reactive component connected to the normally closed RF MEMS switch; and a plurality of additional reactive components, a different one of the plurality of additional reactive components connected to each of the plurality of normally open RF MEMS switches;

wherein the RF MEMS switch circuit applies a default condition to the mobile computing device through the normally closed RF MEMS switch, and the controller causes application of control signals to one of the at least one normally open RF MEMS switches and to the normally closed RF MEMS switch to apply an alternate condition to the mobile computing device instead of the default condition.

2. The mobile computing device of claim 1 wherein the plurality of normally open RF MEMS switches are each activatable by one of the control signals to cause a different alternate condition.

3. The mobile computing device of claim 1, wherein the alternate condition is application of an RF signal to a device external to the mobile computing device.

4. The mobile computing device of claim 1, wherein the default condition is a default frequency.

5. The mobile computing device of claim 1 wherein the first reactive component tunes the antenna to a default frequency and the additional reactive components tune the antenna to alternate frequencies.

6. The mobile computing device of claim 1, wherein the mobile computing device is one of a mobile telephone, cellular telephone, a wireless radio, a portable computer, a laptop, an MP3 player, a satellite radio, a satellite television, a Digital Video Recorder (DVR), and a television set-top box.

7. An apparatus for applying a default condition or an alternate condition in a mobile computing device, the apparatus comprising:

an RF MEMS switch circuit including a plurality of normally open RF MEMS switches and a normally closed RF MEMS switch;

a controller connected to the RF MEMS switch circuit;

an antenna connected to the RF MEMS switch circuit;

a first reactive component connected to the normally closed RF MEMS switch; and a plurality of additional reactive components, a different one of the plurality of additional reactive components connected to each of the plurality of normally open RF MEMS switches;

wherein the RF MEMS switch circuit applies a default condition to the mobile computing device through the normally closed RF MEMS switch, and the controller causes one of the at least one normally open RF MEMS switch to apply an alternate condition to the mobile computing device instead of the default condition.

8. The apparatus of claim 7 wherein the plurality of normally open RF MEMS switches are each activatable by a control signal to cause a different alternate condition.

9. The apparatus of claim 7 wherein the alternate condition is application of an RF signal to a device external to the mobile computing device.

10. The apparatus of claim 7, wherein the default condition is a default frequency.

11. The apparatus of claim 7 wherein the first reactive component tunes the antenna to a default frequency and the additional reactive components tune the antenna to alternate frequencies.

12. The apparatus of claim 7, wherein the mobile computing device is one of a mobile telephone, cellular telephone, a wireless radio, a portable computer, a laptop, an MP3 player, a satellite radio, a satellite television, a Digital Video Recorder (DVR), and a television set-top box.

* * * * *